US007780151B2

(12) United States Patent
Carroni

(10) Patent No.: US 7,780,151 B2
(45) Date of Patent: Aug. 24, 2010

(54) MIXER ASSEMBLY

(75) Inventor: Richard Carroni, Niederrohrdorf (CH)

(73) Assignee: ALSTOM Technology Ltd., Baden (CH)

( * ) Notice: Subject to any disclaimer, the term of this patent is extended or adjusted under 35 U.S.C. 154(b) by 734 days.

(21) Appl. No.: 11/624,733

(22) Filed: Jan. 19, 2007

(65) Prior Publication Data

US 2007/0113555 A1 May 24, 2007

Related U.S. Application Data

(63) Continuation of application No. PCT/EP2005/054083, filed on Aug. 18, 2005.

(30) Foreign Application Priority Data

Aug. 27, 2004 (CH) ..... 1408/04

(51) Int. Cl.
*F02M 29/06* (2006.01)

(52) U.S. Cl. ..... 261/79.1; 60/748; 261/79.2; 261/118; 261/DIG. 55

(58) Field of Classification Search ..... 261/79.1, 261/79.2, 78.1, 78.2, 118, DIG. 55; 60/737, 60/740, 748
See application file for complete search history.

(56) References Cited

U.S. PATENT DOCUMENTS 1,756,805 A * 4/1930 Baker ..... 261/79.1

(Continued)

FOREIGN PATENT DOCUMENTS

DE 3151683 A1 * 11/1982 ..... 261/79.1
EP 0686813 12/1995
WO WO2006/021543 3/2006

OTHER PUBLICATIONS

Hack, R. L., et al., "Design and Testing of a Unique, Compact Gas Turbone Catalytic Combustor Premixer," Proceedings of ASME Turbo Expo 2003, pp. 573-583, Power for Land, Sea and Air, Jun. 16-19, 2003, Atlanta, Georgia, USA.

(Continued)

*Primary Examiner*—Richard L Chiesa
(74) *Attorney, Agent, or Firm*—Cermak Nakajima LLP; Adam J. Cermak

(57) ABSTRACT

A mixer assembly and a method for forming a fuel-air mixture is combinable with a burner system of a heat engine, especially a gas turbine plant. A flow-through component (1) provides a flow deflecting region (8) which provides at least two air inlet openings (2, 3, 4) to which is each connected a flow passage section (5, 6, 7), which flow deflecting region deflects the airflow which enters the respective flow passage section (5, 6, 7) by a deflection angle $\beta \neq 0°$, and each has an outlet opening, and that a mixing passage section (11, 12, 13) is connected to each of the outlet openings of the flow passage sections (5, 6, 7), in each of which mixing passage section is provided at least one flow vortex generating structure (14), and which each provides an outlet opening; or that a fine mixing region (15) is connected to the outlet openings of the flow passage sections (5, 6, 7), which fine mixing region has a multiplicity of individual flow passages (23) which, in each case, have a passage cross section which is dimensioned smaller than the passage cross section of the flow passage sections (5, 6, 7) in the region of their outlet openings; or that a mixing passage section (11, 12, 13) is connected to the outlet openings of the each of flow passage sections (5, 6, 7), in each of which mixing passage section at least one flow vortex generating structure (14) is provided.

19 Claims, 6 Drawing Sheets

U.S. PATENT DOCUMENTS

| | | | | | |
|---|---|---|---|---|---|
| 2,843,368 | A | * | 7/1958 | Schmidt | 261/79.1 |
| 3,336,017 | A | * | 8/1967 | Kopa | 261/128 |
| 3,395,899 | A | * | 8/1968 | Kopa | 261/22 |
| 3,512,359 | A | * | 5/1970 | Pierce | 60/748 |
| 3,667,221 | A | * | 6/1972 | Taylor | 60/737 |
| 3,720,058 | A | * | 3/1973 | Collinson et al. | 60/746 |
| 5,577,378 | A | | 11/1996 | Althaus et al. | |
| 5,672,187 | A | * | 9/1997 | Rock et al. | 95/219 |
| 5,983,642 | A | | 11/1999 | Parker et al. | |
| 6,026,644 | A | | 2/2000 | Ito et al. | |
| 6,244,573 | B1 | * | 6/2001 | Rock | 261/79.1 |
| 6,536,748 | B1 | * | 3/2003 | Tachihara et al. | 261/79.2 |
| 6,736,376 | B1 | * | 5/2004 | DeLisle | 261/79.1 |
| 2001/0042927 | A1 | * | 11/2001 | Rock | 261/79.1 |

OTHER PUBLICATIONS

Search Report for Swiss Patent App. No. CH 1408/04 (Nov. 25, 2004).

International Search Report for PCT Patent App. No. PCT/EP2005/054083 (Dec. 16, 2005).

International Preliminary Examination Report for PCT Patent App. No. PCT/EP2005/054083 (Nov. 23, 2006).

* cited by examiner a) b)

a)

b)

MIXER ASSEMBLY

This application is a Continuation of, and claims priority under 35 U.S.C. §120 to, International application number PCT/EP2005/054083, filed 18 Aug. 2005, and claims priority under 35 U.S.C. §119 therethrough to Swiss application number 01408/04, filed 27 Aug. 2004, the entireties of both of which are incorporated by reference herein.

BACKGROUND OF THE INVENTION

1. Field of the Invention

The invention relates to a mixer assembly and also to a method for mixing and producing a fuel-air mixture which is fed to a burner system for operating a heat engine, especially a gas turbine plant.

2. Brief Description of the Related Art

For the operation of high-performance heat engines, especially gas turbine installations, there are high requirements with regard to the production and making available of an ignitable fuel-air mixture which is mixed through as homogenously as possible, by means of the combustion of which fuel-air mixture inside a combustion chamber hot gases are formed which serve for driving turbine stages, by means of which a generator is ultimately driven for electrical power production.

In order to carry out the combustion process as efficiently as possible, and, furthermore, to make sure that all of the fuel which is mixed with air is combusted, it is necessary to feed to the burner system a homogenously mixed fuel-air mixture in the form of a mixture flow which has a largely equally distributed velocity profile along the total flow cross section.

It is obvious that to similarly increase the demands which are to be made on the mixer assemblies by the increase in performance of modern heat engines, it is necessary to make available ever greater amounts of fuel-air mixtures, particularly as the swallowing capacity of such modern plants becomes continually greater. Also, the aspect of the increasing overall size and complexity, especially in modern high performance gas turbine plants, plays an important role in the design of required mixer assemblies. Therefore, it is necessary to form the mixer assembly as flexibly as possible on a large scale so as not to have to provide a specially adapted mixer design for each individual gas turbine plant which is formed with a different power output.

In particular, the use of so-called catalytic burner systems, which are used increasingly in high-performance gas turbine plants especially for reasons of avoiding pollutant emissions, require a large mass flow of fuel-air mixture which mixes as homogenously as possible and which is to have an uniformly distributed velocity profile along the total flow cross section before entry into the catalyst unit.

To date, only unsatisfactory solutions for mixing and making available such fuel-air mixtures are known, as they are gatherable, for example, from an article by R. L. Hack et al., "Design and Testing of a Unique, Compact Gas Turbine Catalytic Combustor Premixer", Proceedings of ASME Turbo Expo 2003, Paper No. GT 2003-38778, Jun. 16-19, 2003, Atlanta, USA. Therefore, the inlet air flow in a so-called "Baseline Mixer" is guided through flow passage sections which twice deflect the flow by 180° in each case before the inlet air is mixed with fuel, which is subsequently mixed by a sequence of a plurality of static mixers, forming a fuel-air mixture. In order to optimize the fuel entry into the inlet air flow with regard to an improved mixing result, a mixer assembly is described in an improved embodiment variant in which the fuel is injected along a flow deflecting contour, by means of which the inlet air flow is deflected by 180°. The fuel injection takes place through passage side walls which bound the flow deflecting contour, in which side walls fuel nozzles are introduced, which inject the fuel into the air flow basically perpendicularly to the flow direction.

The mixer assemblies which are described in the aforementioned article, however, are only suitable for requirements of low burner capacity, especially as the flow deflecting contours at increased flow velocities, especially in regions of small curvature radii, lead to flow separations close to the passage wall, as a result of which flow regions with flow reversal are created, which ultimately lead to inhomogeneities along the flow profile. Furthermore, the double curvature along the air feed passage does not allow any desired compact construction which would be desirable, however, for reasons of an integration into a high-performance gas turbine plant. Considerable mass flows of a homogenous, mixed through fuel-air mixture have to be fed to such plants, which requires high flow velocities at which flow separations are unavoidably established, especially in the region downstream of the passage contours which deflect the flow by 180°, which flow separations, however, it is necessary to avoid.

SUMMARY OF THE INVENTION

One of numerous aspects of the present invention involves forming a mixer assembly for forming a fuel-air mixture which is combinable with a burner system of a heat engine, especially a gas turbine plant, in such a way that producing a fuel-air mixture of high-performance gas turbine applications is possible without having to accept the aforementioned disadvantages of the prior art. It is especially advantageous to make available a large mass flow of a fuel-air mixture, wherein during the whole mixing no flow separations, which cause pressure zones, backflow zones, or dead water zones, are to occur along the flow passages inside the mixer assembly. It is also advantageous to avoid any regions inside the mixer assembly in which regions of increased risk of spontaneous ignition are formed by local fuel accumulations. Furthermore, the fuel-air mixture which is made available by the mixer assembly is preferably suitable for firing a catalytic burner, i.e., the mixture flow advantageously has, as far as possible, a largely uniform velocity profile along the flow cross section. Finally, the mixer assembly is preferably formed as compact and small in construction as possible in order to achieve a high integratability and also the possibility of retrofittability, i.e., retrofittability to burner systems which already exist.

Another aspect of the present invention includes a method by which the efficient production of a fuel-air mixture for the operation of high performing modern gas turbines is possible.

In contrast to known mixer assemblies for forming a fuel-air mixture, which are combinable with a burner system of a heat engine, especially a gas turbine plant, and which have a flow-through component in each case which provides at least one air inlet opening, at least one flow outlet opening, a flow passage which connects the air inlet opening to the flow outlet opening, and also at least one fuel feed which is located in the region of the air inlet opening and/or along the flow passage, a new type mixer assembly embodying principles of the present invention provides a flow deflecting region which has at least two air inlet openings to which is connected in each case a flow passage section which deflects an air flow entering the respective flow passage section by a deflection angle $\beta \neq 0°$, preferably $90° \leqq \beta \leqq 180°$, and has an outlet opening in each case through which the individual deflected partial flows emerge, preferably at the same velocity. By means of the new type of distribution of the air flow, which enters the flow-through component, into partial flows which in each case propagate along the flow passage sections, it is possible, by means of suitably selected flow passage section geometries, to deflect the individual partial flows preferably by an angle β of at least 90°, and this especially at high flow velocities, with only minimal pressure loss and largely without flow separation phenomena.

A number of fluidic investigations has proved that a deflection of a total flow by a predeterminable deflection angle can be conducted with lower flow and pressure losses, as long as the total flow is divided into individual partial flows which are directed in each case through flow passage sections which are formed favorable to flow, than in comparison to the flow deflection of a single flow passage which commonly envelops the total flow.

Similar to generic type mixer assemblies, the fuel injection in the mixer assembly according to the present invention also takes place in the region of the air inlet openings and/or along the flow passage sections which deflect the air flow, which flow passage sections are formed in each case in such a way that the individual partial flows, which pass through the flow passage sections, flow through largely isokinetically, i.e., at constant velocity. This requirement is to be ensured by means of the suitable selection of the ratio of cross section and curvature of the respective flow passage section. The partial flows of the fuel-air mixture which are formed, which emerge from the individual outlet openings of the flow passage sections, have uniform flow velocities with regard to each other on account of the isokinetic flow-through characteristic and also on account of the outlet openings which are equally dimensioned in each case.

In order to improve the degree of mixing of the partial flows of fuel-air mixture which are formed along the flow passage sections, an alternative exemplary embodiment of the mixer assembly provides an after-mixing region which is connected downstream directly to the flow deflecting region and which has individual mixing passage sections which are connected downstream flush to the flow passage sections in each case, and in which the respective partial flows of fuel-air mixture experience a further mixing. A flow vortex generating structure, which is introduced into each mixing passage section, serves for this purpose in each case, by means of which, without pressure loss if possible, a strong swirling is induced of the partial flow which passes through the individual mixing passage sections in each case. The individual mixing passage sections have an outlet opening in each case in such a way that the partial flows which emerge from the mixing passage sections are concentrated into a spatially compactly uniform total flow which, in this form, leaves the mixer assembly. The fuel-air mixture which is produced in this way is then fed directly to a burner system, if necessary to a catalytically supported burner system.

A further exemplary embodiment, instead of the mixing passage sections which are provided with flow vortex generating structures, provides a so-called fine mixing region which is assembled from a number of individual flow passages which are arranged in each case along concentric annular sections and have flow cross sections with flow passage diameters of between 0.5 and 5 mm. Moreover, the individual flow passages per annular section are set at an angle of incidence ±δ to the flow direction by which the fuel-air mixture leaves the flow deflecting region, i.e., all flow passages, which are located in a coaxial annular section, are arranged parallel to each other; however, the flow passage longitudinal axes between two radially adjacent annular sections are located alternately by +δ or −δ in each case, in order to create in this way, downstream of the fine mixing structure, strongly tangentially acting shear forces between the individual flow regions emerging from the annular sections, in order to optimize the degree of mixing through of the fuel-air mixture. Furthermore, the multiplicity of flow passages which are divided into the annular sections act with homogenizing effect on the flow direction, i.e., the flow which emerges from the fine mixing structure experiences a spatial flow concentration which ultimately also affects the axial velocity profile with unifying effect. A further advantage of the fine mixing structure, moreover, is that on account of the only small flow passage cross sections in the millimeter range and below, any risk of a backflash in the course of quenching can be excluded by the fine mixing structure.

Moreover, the tangential shear forces which are formed downstream of the fine mixing structure between the individual annular flows by shear layer formations are conducive to the averting of backflashes of any type.

In a preferred further embodiment, the mixer assembly includes all three of the previously described flow-through components, that is to say the flow deflecting region, the mixing passage sections, and also the previously described fine mixing region. This embodiment variant is subsequently explained in detail with reference to the exemplary embodiments which are shown in the following figures.

All mixer assemblies according to the present invention are based on a common method concept which can be described by the following method stages:

In a first stage, make available an air flow which is directed into at least two separate flow passage sections, wherein the air flow splits into a partial flow in each case and is deflected by a deflection angle β from its original direction of propagation. The air flow is usually made available by a compressor unit and arrives in a plenum in which the new type flow-through component of the mixer assembly is located. Upstream and/or along the individual flow passage sections, the fuel is injected into the air flow for forming the desired fuel-air mixture, for which fuel both liquid fuel and gaseous fuel can be used. Therefore, an isokinetic fuel-air mixture is formed already along the flow passage sections which deflect the flow, which fuel-air mixture, largely without pressure losses, leaves the flow deflecting region downstream.

In order to improve the degree of mixing of the fuel-air mixture which is formed, either flow vortices, which optimize the degree of mixing through, are introduced by suitable flow vortex generating structures into the flow which emerges from the flow deflecting region, or the flow which emerges from the flow deflecting region is homogenized directly by use of the previously described fine mixing structure, and is channeled accordingly into a uniform fuel-air mixture flow. The shear forces which are induced by the fine mixing structure and which act tangentially between the annular flows which propagate coaxially to each other, are able to increase the degree of mixing through of the fuel-air mixture in a similarly efficient way. In a preferred way, however, both measures which optimize the degree of mixing are used in combination, i.e., the fuel-air mixture which emerges from the flow deflecting region first experiences a macroscale swirling in the region of the mixing passage sections before the fuel-air mixture enters the fine mixing region.

Methods embodying principles of the present invention enable the forming of a fuel-air mixture which propagates along a propagation axis and is homogenously mixed through over the whole flow cross section, and which, in addition, has an isokinetic flow profile which, in a preferred way, is usable for catalytically operable burner systems. By means of the separation, according to the present invention, of the available air flow into at least two, preferably three or four partial flows, which are to be separately deflected, it is possible to effect the deflection of the partial flows largely loss free, i.e., without pressure losses and flow separations in the region of the deflecting zones so that directly downstream of the flow deflecting region each individual partial flow has an isokinetic flow profile which are formed identically to each other in each case. The following measures serve ultimately for the optimization and homogenization of the degree of mixing.

A flow deflection by a deflection angle β of 90° has proved to be especially advantageous, especially as in this case, in a flow-through component which is formed rotationally symmetrically, an air flow which is directed radially onto the flow-through component can be deflected into an axially oriented air flow. This enables an unusually compact flow guiding inside the mixer assembly and, moreover, allows the retrofitting to burner systems which already exist.

BRIEF DESCRIPTION OF THE DRAWINGS

The invention is exemplarily described below on the basis of exemplary embodiments with reference to the drawings, without limitation of the general idea of the invention. In the drawings.

DETAILED DESCRIPTION OF EXEMPLARY EMBODIMENTS

Figure 1:
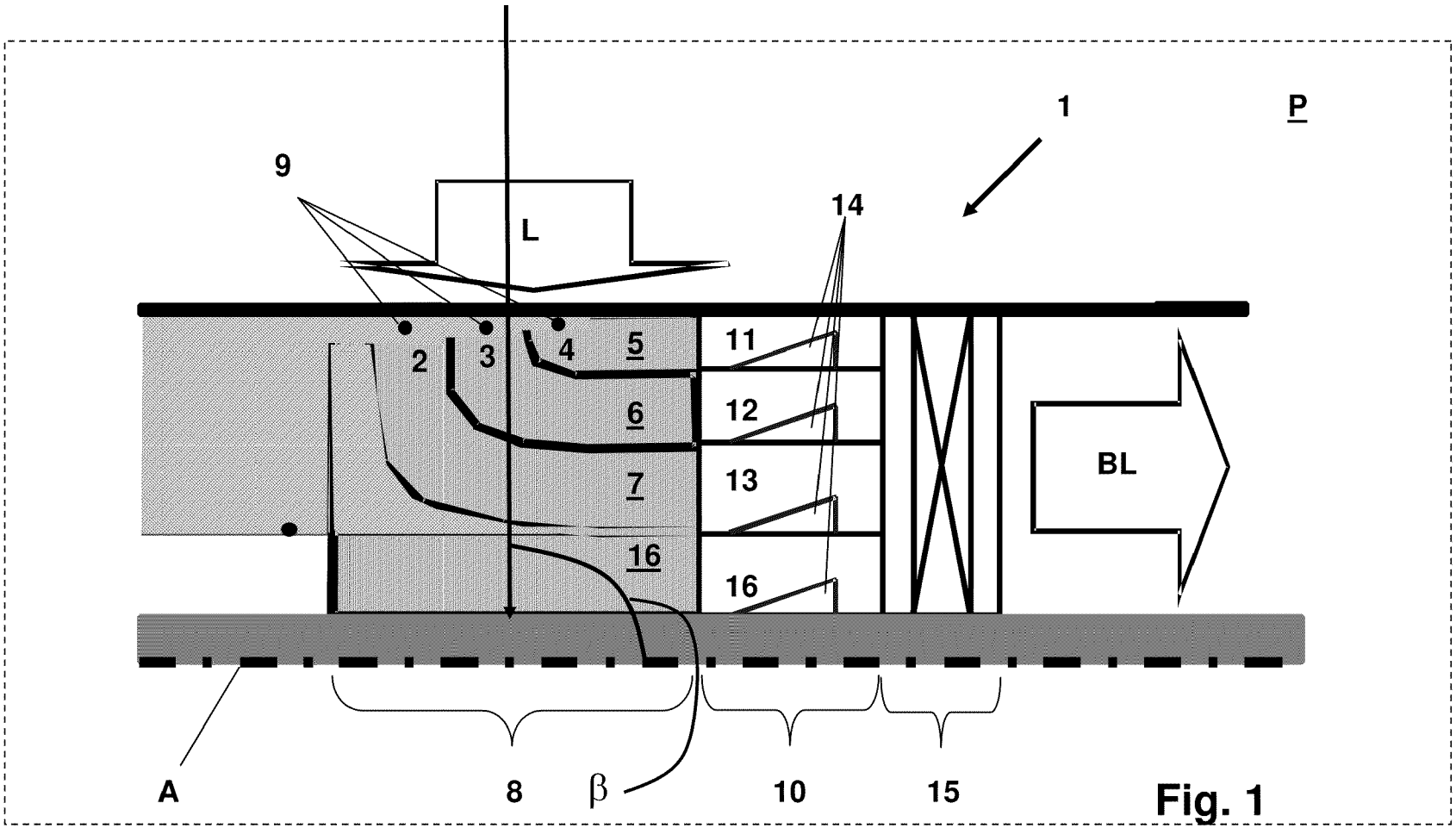
FIG. 1 shows a schematized longitudinal sectioned view through a mixer assembly which is formed as a flow-through component.

The mixer assembly, which is schematically shown in FIG. 1, shows the upper half of a flow-through component 1, which is otherwise rotationally symmetrically formed, which is intersected by an axis A. It is assumed that the mixer assembly, which is formed as a flow-through component 1, is located inside a plenum P into which is injected air which is compressed by means of a compressor unit (not shown), which air flows basically radially to the axis A through air inlet openings 2, 3, 4 into the flow-through component. Flow passage sections 5, 6, 7 are connected directly downstream to the air inlet openings 2, 3, 4, along which flow passage sections the partial flows are deflected by 90° from their originally radially oriented flow direction. The flow deflecting region 8, therefore, is able to distribute the total air flow L, which acts radially upon the flow-through component 1, both into partial flows and also to deflect it by 90° into an axially oriented flow direction. For forming a fuel-air mixture, means 9 for fuel feed are located in the region of the air inlet openings 2, 3, 4, which means are provided as correspondingly formed fuel nozzles, depending upon the type of fuel, whether it is liquid or gaseous.

For efficient mixing through of the fuel-air mixture which is formed along the flow passage sections 5, 6, 7, a mixing passage region 10, which further optimizes the degree of mixing, is provided directly downstream to the flow deflecting region 8, which mixing passage section 10 provides mixing passage sections 11, 12, 13 which are connected flush to the flow passage sections 5, 6, 7 in each case, in which mixing passage sections vortex generating structures 14 are provided which, in a way largely free of pressure losses, generate in the partial flows flow vortex pairs in each case which are conducive to an improved mixing through of the fuel.

Figure 6:
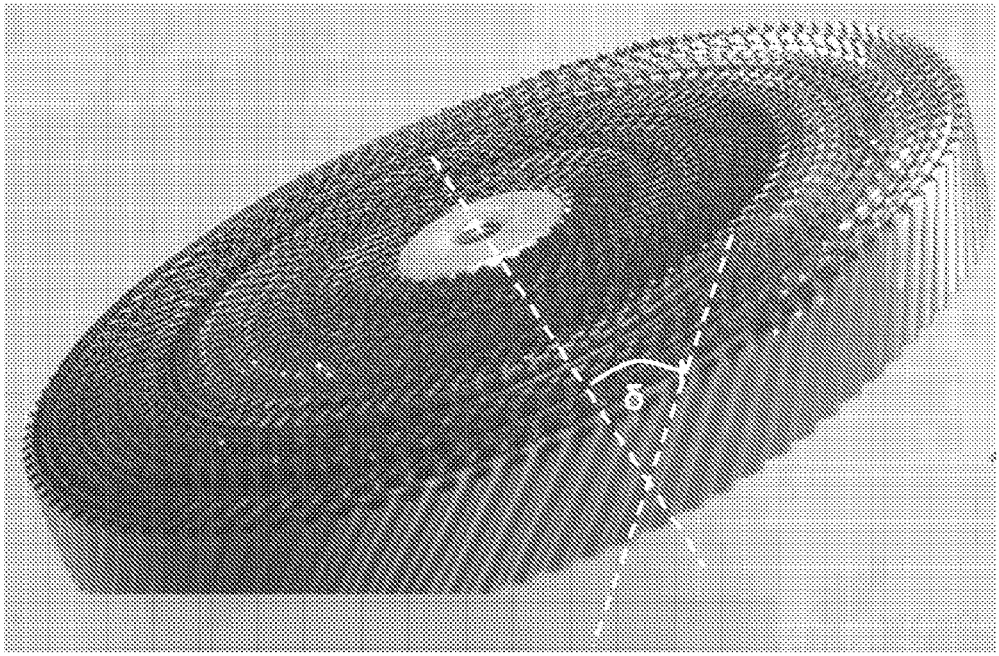
Figure 6:
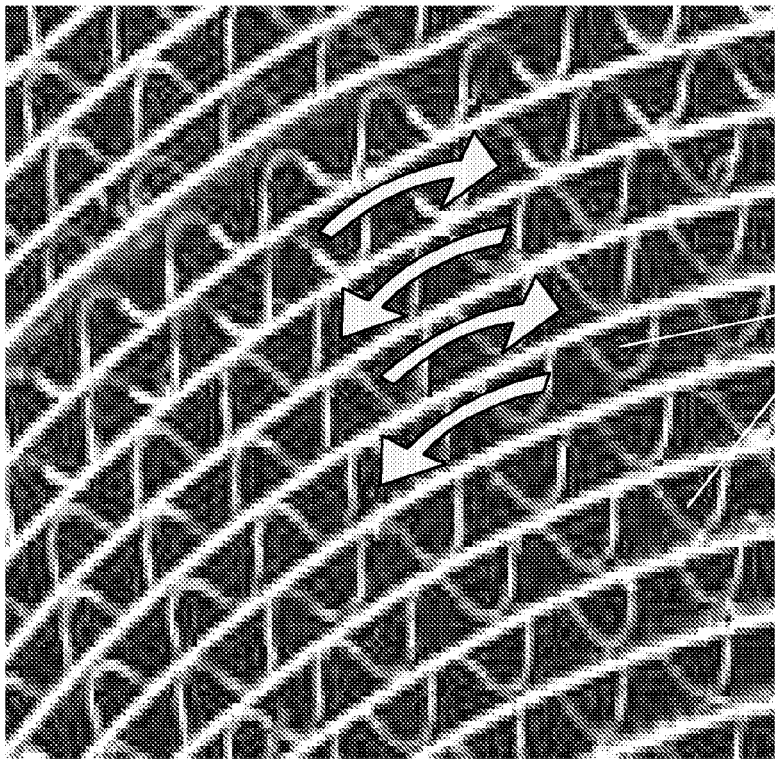

The fine mixing region 15 is connected downstream to the mixing passage region 10, which fine mixing region, as is subsequently explained again with reference to FIG. 6, transfers the premixed through partial flows which emerge from the individual mixing passage sections 11, 12, 13 to a total flow which propagates axially, with a further improved degree of mixing through and also with a homogenized velocity profile. It is preferable to locate the fine mixing structure of the fine mixing region coaxially downstream to the mixing passage sections in a region at a distance from them in which the flow vortices, which are induced by means of the vortex generating structures, are largely attenuated.

The fuel-air mixture BL, which is formed downstream of the mixer assembly 1, therefore, has a homogenous fuel-air distribution and also velocity distribution across the whole flow cross section, so that the subsequent combustion process, which is not shown, can take place completely without residues. The mixer assembly which is shown is especially suitable for forming an ignitable fuel-air mixture for injection into a catalyst arrangement for further catalytic combustion.

Figure 2:
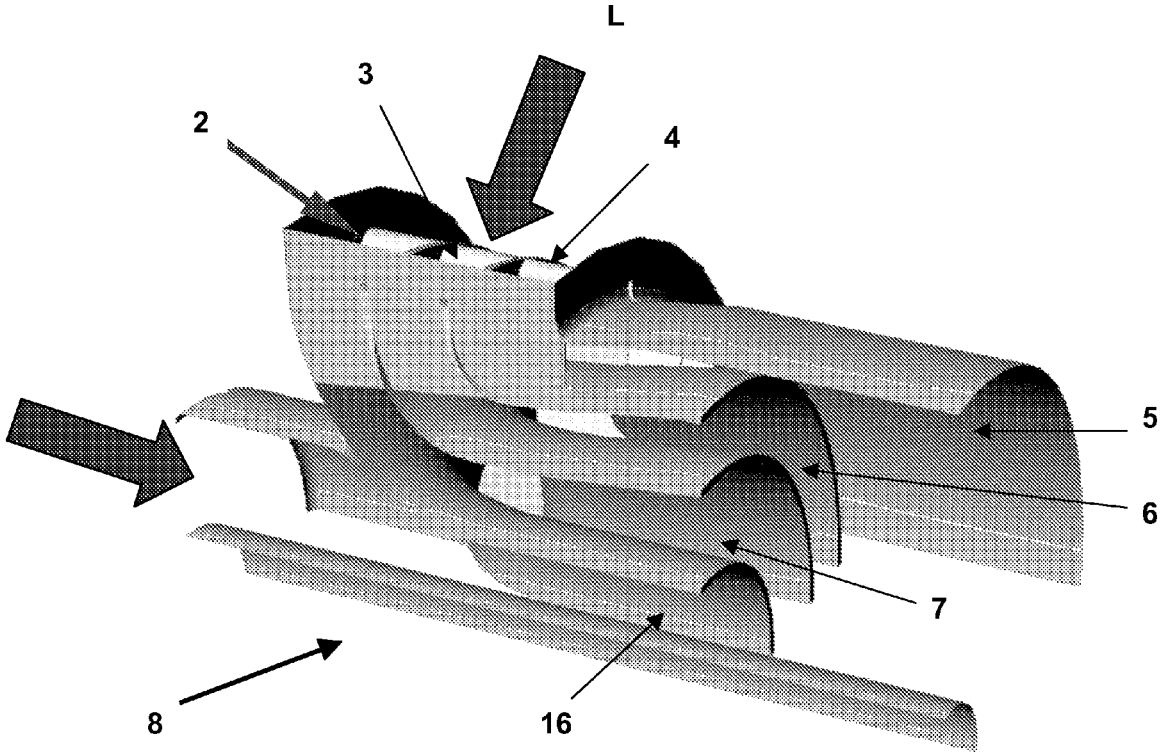
FIG. 2 shows a three-dimensional view of a sub-region of the flow deflecting region with flow passages which adjoin in the axial direction, FIG. 3*a, b* show perspective views of a flow-through component which is formed three-dimensionally, with a flow deflecting region and also mixing passage sections which are connected to it, FIG. 4*a, b* show a longitudinal sectioned view and a cross sectional view of a means for fuel injection, FIG. 5*a, b* show schematized views of vortex generating structures along the mixing passage sections, and FIG. 6*a, b* show a view of a fine mixing structure with flow passages which are annularly arranged.

A perspective partial view of the flow passage sections 5, 6, 7 of the flow deflecting region 8 is shown in FIG. 2. The flow passage sections 5, 6, 7 which deflect the main air flow L from the radial direction into the axial direction are bounded by flow passage walls in each case, which are able to deflect the individual partial flows largely isokinetically, i.e., at constant velocity, avoiding any pressure losses. The opening sizes of the air inlet openings 2, 3, 4 are adapted in each case to the curvature of the continuing flow passage section in order to ensure an isokinetic flow behavior along the respective flow passage sections 5, 6, 7. The design of the individual flow passage walls is selected in such a way that the outlet openings of the individual flow passage sections 5, 6, 7 have an uniformly dimensioned outlet area in each case so that the flow velocity at which the individual partial flows leave the flow passage sections 5, 6, 7 is the same in each case, in order to additionally ensure in this way that the partial flows which pass through the individual flow passage sections 5, 6, 7 in each case have an equal mass flow in each case.

Furthermore, prime consideration was given to the forming of the respective curvatures along the individual flow passage sections 5, 6, 7 in order to avoid flow separations along the flow passage wall sections. Therefore, especially the flow passage section 5, which provides a flow deflection by 90° along the shortest flow path, has a larger air inlet opening 4 in order to avoid high flow velocities occurring in the region of the largest flow passage curvature, which would lead to flow separations along the flow passage wall. By means of the larger selected air inlet opening 4, somewhat lower flow velocities occur locally in the region of the largest passage curvature in the flow passage section 5, which, however, by means of a near-edge acceleration of the flow which is present in the passage section 5, at least in the outlet region of the flow passage section 5, exit at the same flow velocity as the partial flows in all other flow passage sections.

A bypass passage 16 additionally passes through the flow passage arrangement which is shown in FIG. 2. Fuel can also be injected along the bypass passage 16, according to requirement, for forming a fuel-air mixture which, as is shown in FIG. 1, similarly reaches the mixing passage region 10 and also the fine mixing region 15.

Figure 3:
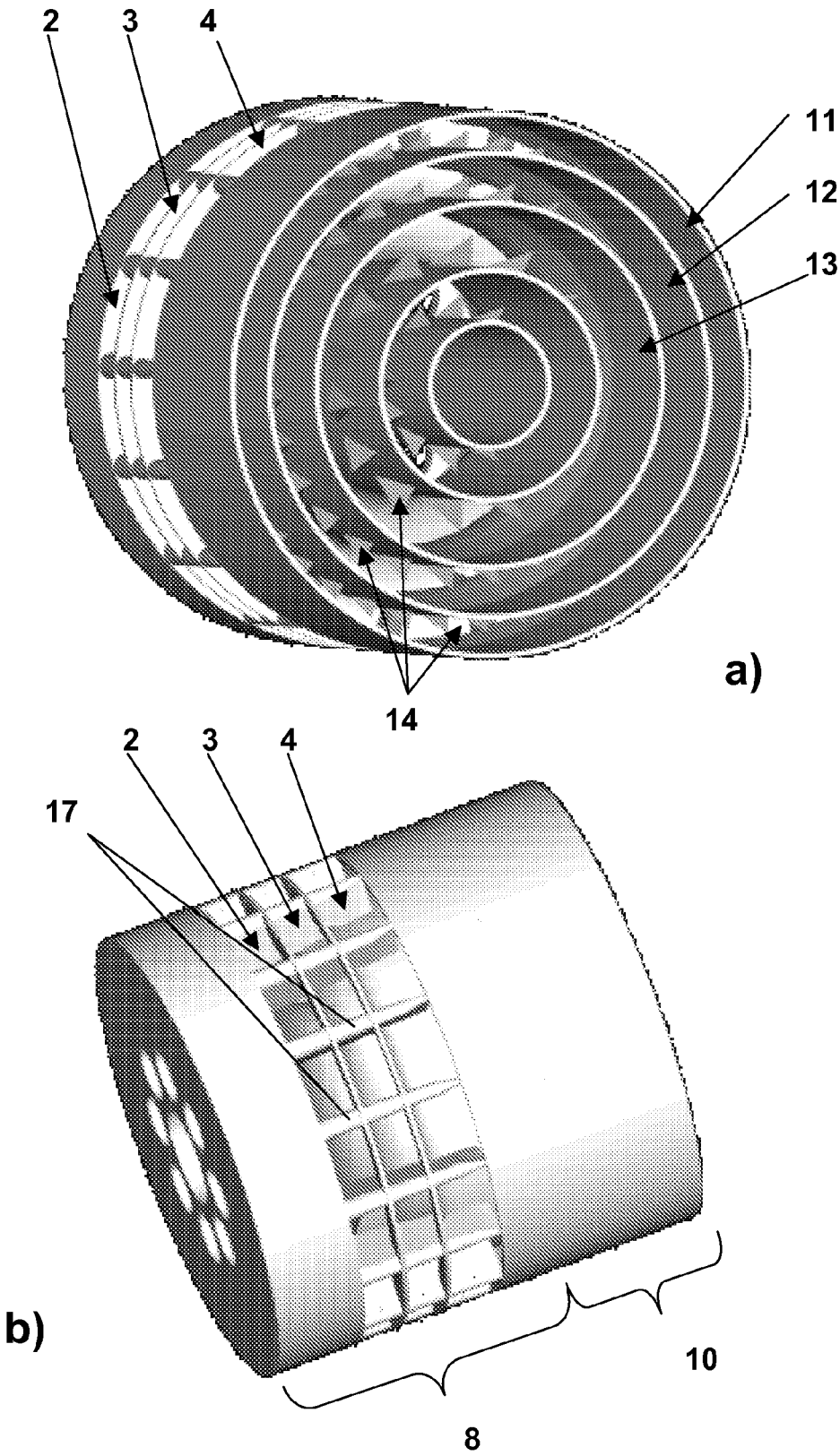

The rotationally symmetrically formed flow-through component 1 of the mixer assembly, with the flow deflecting region 8 and also the mixing passage region 10 which is connected to it, is shown in FIGS. 3*a* and 3*b*, to which reference is commonly made in the following. The cylindrically formed flow-through component 1 has the air inlet openings 2, 3, 4 in the flow-through region 8 in a completely encompassing manner in the circumferential direction. The larger dimensioned air inlet opening 4, through which the air flow, which radially strikes the flow-through component 1, is deflected by the shortest way by 90°, i.e., deflected axially, is clear to see in the view according to FIG. 3*b*. From the view according to FIG. 3*a*, the individual vortex generating structures 14 which are provided along the mixing passage sections 11, 12, 13 can be seen, which structures are dealt with further in the following. In order to maintain isokinetic flow ratios of the partial flows which propagate axially, the flow passage cross sections of the individual flow passage sections 5, 6, 7, or the mixing passage sections 11, 12, 13 which are connected directly to them, as the case may be, are equally dimensioned in each case.

The type of construction which is shown in FIGS. 3*a* and *b* allows the exceptionally compact form of the mixer assembly to be clearly seen, by means of which an easy integration into burner systems which already exist is possible.

Figure 4:
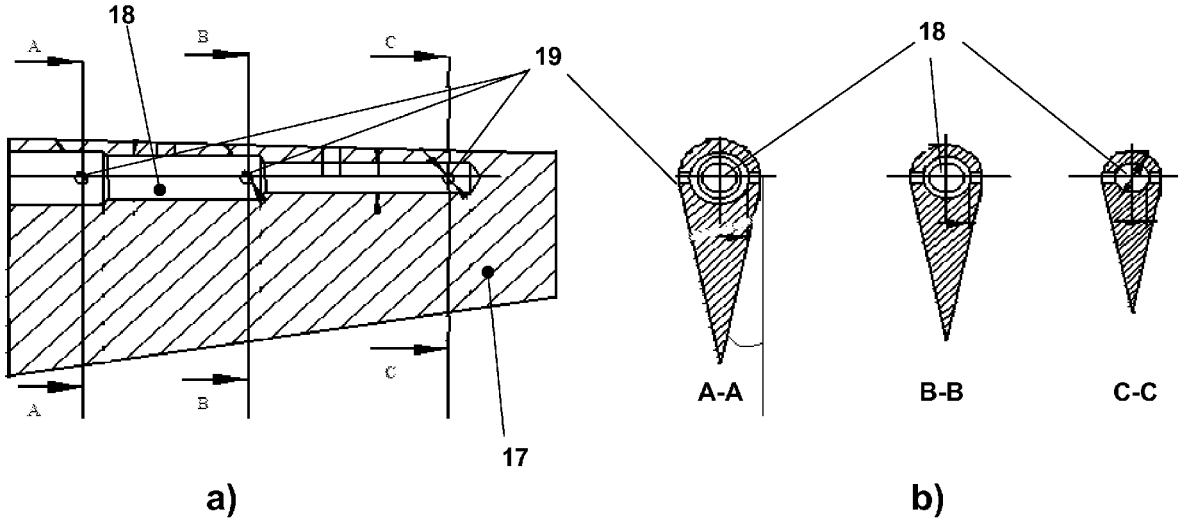

For fuel injection, flow profile struts 17, which are axially oriented, are provided in the region of the air inlet openings, which struts are arranged in an equally distributed manner in the circumferential direction of the flow-through component 1 in each case, and in which are provided fuel nozzles for fuel injection. A detailed view of such a flow profile strut 17 is shown in FIGS. 4*a* and *b*. FIG. 4*a* shows a longitudinal section through such a flow profile strut 17, along which extends a bore 18, which is axially oriented, which provides side fuel nozzle orifices 19 in the region of the air inlet openings in each case. Sectioned drawings along the section lines AA, BB, and CC are shown in each case in FIG. 4*b*. The fuel nozzle orifices 19, which are oriented in the circumferential direction in each case, through which fuel can be injected in each case into two air inlet openings which are directly adjacent in the circumferential direction, are clearly illustrated.

The fuel injection into the respective air inlet openings takes place with consideration for an optimized injection depth and also atomization rate. Therefore, it is necessary to carry out the fuel injection while taking into consideration a pressure loss which is as low as possible inside the air flow which passes through the air inlet openings.

In order to ensure that an exactly identical fuel-mixture ratio is formed inside each individual partial flow, the dimensioning of the fuel feed passage 18, and also the fuel nozzle orifices 19, are suitably selected so that an exactly equal fuel mass flow is injected into each individual air inlet opening. In a suitable manner, the number of fuel orifices, their orienting and also opening sizes are to be suitably selected in order to design the fuel distribution as uniformly as possible and especially to avoid fuel concentration enrichments close to the flow passage walls. For the entry of gaseous fuel, fuel orifices with diameters of between 0.5 and 3 mm have proved to be favorable.

In order to irritate as little as possible the airflow entering through the air inlet openings, the flow profile struts are formed aerodynamically favorably and have a contour which tapers in the flow direction, which contour is defined by the profile angle Ca (see FIG. 4*b* concerning this). The design of the flow profile struts is constructed with consideration for a lowest possible flow irritation and also flow blockage. In this case, it is especially necessary to avoid flow pressure zones and also backflow zones in the region of the flow profile struts.

It could also be considered to provide additional fuel injection points along the flow passage sections 5, 6, 7, especially in the region of the flow passage walls which have the largest curvatures. However, this requires costly fuel passage feed lines which is counter to the requirement for a simplest possible form of the mixer assembly.

Figure 5:
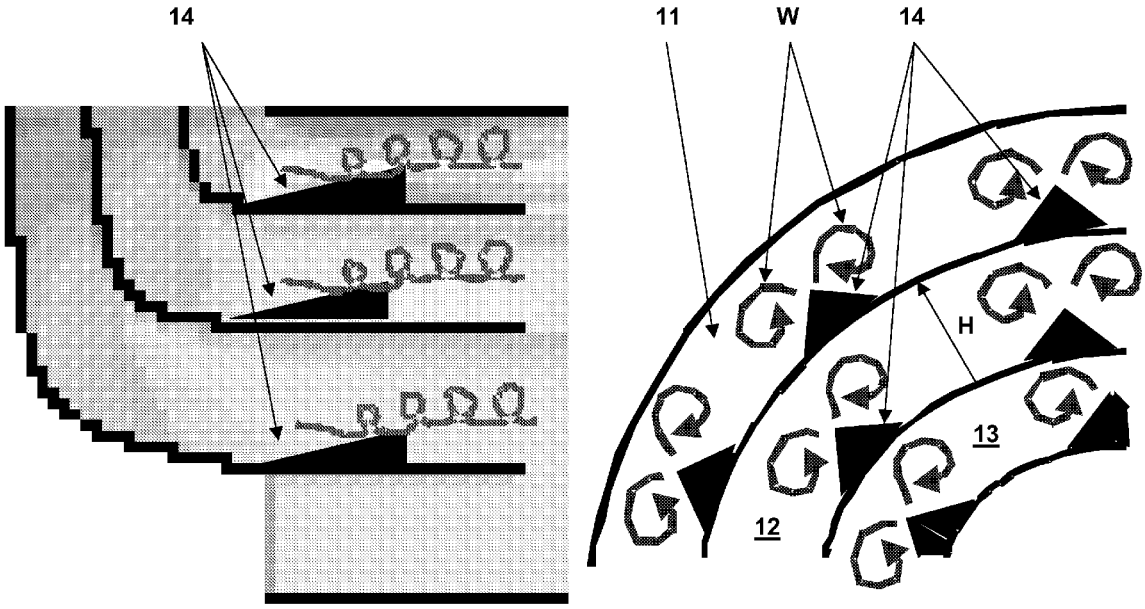

In order to improve the degree of mixing through of the fuel-air mixture which is formed by the fuel injection, which mixture begins to form along the individual flow passage sections 5, 6, 7, vortex generating structures 14 are supplied, which are provided along mixing passage sections 11, 12, 13 which are connected downstream to the flow passage sections 5, 6, 7 (see FIGS. 5*a* and 5*b* concerning this). The vortex generating structures 14 preferably have a wedge-shaped contour which widens prismatically in the flow direction. The vortex generators 14 are able to form large-scale vortex pairs W, largely without pressure loss and recirculation zones, as this is to be gathered especially from the partial cross sectional view in FIG. 5*b* through the individual mixing passage sections 11, 12, 13. Especially preferred vortex generating structures 14 have a maximum structure height of 0.3 to 0.8 of the mixing passage height H. Preferred length and height ratios of the individual structures lie between 1.4 to 3.5, wherein the structures have a wedge angle of between 10° and 30°. Detailed particulars concerning this can be gathered from U.S. Pat. No. 5,577,378.

The individual annular partial flows which emerge from the respective mixing passage sections 11, 12, 13 are concentrated downstream of the mixing passage section 10 into a cylindrically formed, total flow which, taken by itself, already has a highly homogenous degree of mixing and also a homogenous velocity profile. In order to feed the fuel-air mixture which is formed at this stage to a further mixing through, the mixer assembly according to the solution, according to the drawing view in FIG. 1, provides a fine mixing region 15 which is connected downstream to the mixing passage region 10. Such an arrangement which carries out the fine mixing is apparent in FIGS. 6*a* and 6*b*. The fine mixing structure which is connected flush downstream to the mixing passage region 10 has a multiplicity of individual flow passages 23 which are arranged in concentric annular sections 20, 21, 22, the flow passage cross sections of which are dimensioned very much smaller than those of the individual mixing passage sections 11, 12, 13. Therefore, the flow passages 23 have typical flow passage diameters in the magnitude of between 0.5 and 5 mm, preferably 1 mm. The longitudinal direction of the individual flow passages 23 is set at an angle ±δ to the axial flow-through direction A (see FIG. 5*a*), wherein the sign of the angle of incidence between two directly radially adjacent annular sections 20, 21 changes. In FIG. 5*a*, only the angle +δ to the flow axis A is indicated. By means of the fine mixing structure, in summary there ensues the following positive effects on the flow which passes through the arrangement:

By means of the flow passage longitudinal orientation which is located with offset effect per annular section, shear forces, which are oriented tangentially to the flow direction, are induced between the individual annular flow fields which emerge downstream of the fine mixing region, as a result of which the vortex direction between the flows changes in a radially alternating sequence. The result is a fuel distribution which is homogenously formed.

Furthermore, the multipassage-like, monolithic fine mixing structure is conducive to channeling of the emerging fuel-air mixture, i.e., to unify the direction of propagation, wherein the axial velocity profile of the flow which is formed is noticeably unified. The small dimensioned flow passages 23 also help to avoid any risk of backflash by means of the fine mixing arrangement on account of quenching effect and also on account of the forming of shear layers downstream to the fine mixing structure.

List of Designations

1 Flow-through component, mixer assembly
2, 3, 4 Air inlet openings
5, 6, 7 Flow passage section
8 Flow deflecting region
9 Means for fuel feed
10 Mixing passage region
11, 12, 13 Mixing passage section
14 Vortex generating structure
15 Fine mixing region
16 Bypass passage
17 Flow profile strut
18 Fuel feed passage
19 Fuel nozzle orifice
20, 21, 22 Annular section
23 Flow passage While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A mixer assembly for forming a fuel-air mixture, which is useful with a burner system of a heat engine, comprising:

a flow-through component including at least one air inlet opening, at least one flow outlet opening, a flow passage which connects the air inlet opening to the flow outlet opening, and at least one fuel feed located
in the region of the at least one air inlet opening,
along the flow passage, or
both;

wherein the flow-through component further comprises a flow deflecting region which includes at least two of said air inlet openings and a flow passage section for and in fluid communication with each air inlet opening, which flow deflecting region is configured and arranged to deflect an air flow which enters the respective flow passage section by a deflection angle $\beta \neq 0°$, the flow passage sections including an outlet opening for each flow passage section, wherein the flow passage sections are configured and arranged for isokinetic flow-through ratios, wherein $\beta$ is the angle between an inflow direction of air into the at least two air inlet openings and an outflow direction of the outlet opening of the flow passage section; and (a) a mixing passage section connected to each of the outlet openings of the flow passage sections, at least one flow vortex generating structure positioned in each mixing passage section, and each mixing passage section including an outlet opening; or (b) a fine mixing region connected to the outlet openings of the flow passage sections, which fine mixing region includes a multiplicity of individual flow passages which each have a passage cross section dimensioned smaller than the passage cross section of the flow passage sections in the region of the outlet openings of the flow passage sections; or (c) a mixing passage section connected to each of the outlet openings of the flow passage sections, at least one flow vortex generating structure positioned in each mixing passage section, each mixing passage section including an outlet opening, a fine mixing region having a multiplicity of individual flow passages connected to each mixing passage section outlet opening, the individual flow passages each having a passage cross section dimensioned smaller than the passage cross section of the mixing passage sections in the region of their outlet openings.

2. The mixer assembly as claimed in claim 1, wherein the outlet openings of the flow passage sections have equally sized opening areas.

3. The mixer assembly as claimed in claim 1, wherein $90° \leqq \beta \leqq 180°$.

4. The mixer assembly as claimed in claim 1, further comprising:

at least one fuel feed in the region of each of the air inlet openings, configured and arranged to deliver fuel feed fuel perpendicularly to the air flow when entering through the air inlet opening.

5. The mixer assembly as claimed in claim 1, wherein the at least one fuel feed comprises fuel nozzles configured and arranged to deliver liquid fuel or gaseous fuel.

6. The mixer assembly as claimed in claim 1, wherein the outlet openings of the flow passage sections lie in a common plane, and the flows when emerging from the flow passage sections are oriented parallel to each other.

7. The mixer assembly as claimed in claim 1, wherein the flow-through component comprises a hollow cylinder including said at least two air inlet openings, said at least two air inlet openings being radially oriented and extending in the circumferential direction, which at least two air inlet openings are axially separated from each other, and to which at least two air inlet openings are connected to the flow passage sections extending into the inside of the flow-through component, and further comprising:

passage walls bounding each of the flow passage sections, which passage wall have a curved shape after the air inlet openings so that the outlet openings of the flow passage sections are each oriented axially.

8. The mixer assembly as claimed in claim 7, wherein at least two flow passage sections are arranged coaxially to each other and each have an annular flow passage cross section at least in the region of the axially extending flow passage sections.

9. The mixer assembly as claimed in claim 7, further comprising:

at least one bypass passage axially and concentrically, eccentrically, or both, extending through the flow-through component.

10. The mixer assembly as claimed in claim 7, further comprising:

low profile struts positioned axially along the two air inlet openings, the low profile struts arranged in an equally distributed manner in the circumferential direction of the flow-through component, the low profile struts including fuel nozzles.

11. The mixer assembly as claimed in claim 10, wherein the low profile strut fuel nozzles are configured and arranged so that the fuel delivery is perpendicular to the flow direction of the air flow when entering the two air inlet openings.

12. The mixer assembly as claimed in claim 1, comprising (a) or (c), and wherein the mixing passage sections are connected flush to the flow passage sections.

13. The mixer assembly as claimed in claim 1, comprising (a) or (c), and wherein each flow vortex generating structure has a geometry which widens in wedge-form in the flow direction, with a wedge length l, a wedge height h, and a wedge angle γ, with $1.4 \leqq l/h \leqq 3.5$ and $10° \leqq \gamma \leqq 30°$.

14. The mixer assembly as claimed in claim 1, comprising (b), and wherein the multiplicity of individual flow passages in the fine mixing region are arranged groupwise in annular sections which are each arranged coaxially to each other and each radially spaced apart in relation to each other.

15. The mixer assembly as claimed in claim 14, wherein the flow passages per annular section uniformly include an angle +δ or −δ with the axial direction (A), with $0° < \delta \leqq 45°$.

16. The mixer assembly as claimed in claim 15, wherein the flow passages of one annular section include an angle +δ with the axial direction (A), and the flow passages of directly radially adjacent annular sections include an angle −δ with the axial direction (A).

17. The mixer assembly as claimed in claim 14, wherein the flow passages each have a flow diameter of 0.5–5 mm.

18. The mixer assembly as claimed in claim 1, comprising (b), and wherein the multiplicity of individual flow passages in the fine mixing region is located downstream of the mixing passage sections.

19. The mixer assembly as claimed in claim 1, further comprising:

passage walls bounding the flow passage sections, the mixing passage sections, and the flow passages provided in the fine mixing region, along which passage walls there are no flow separating contours or passage curvatures by which pressure zones, backflow zones, or dead water zones are induced.

* * * * *